US010999694B2

(12) United States Patent
Villanueva-Barreiro

(10) Patent No.: US 10,999,694 B2
(45) **Date of Patent: *May 4, 2021**

(54) TRANSFER FUNCTION DATASET GENERATION SYSTEM AND METHOD

(71) Applicant: Sony Interactive Entertainment Inc., Tokyo (JP)

(72) Inventor: Marina Villanueva-Barreiro, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/784,350

(22) Filed: Feb. 7, 2020

(65) Prior Publication Data

US 2020/0275232 A1 Aug. 27, 2020

(30) Foreign Application Priority Data

Feb. 22, 2019 (GB) ..... 1902431

(51) Int. Cl.
*H04S 7/00* (2006.01)

(52) U.S. Cl.
CPC ..... *H04S 7/303* (2013.01); *H04S 2400/11* (2013.01); *H04S 2400/15* (2013.01); *H04S 2420/01* (2013.01)

(58) Field of Classification Search
CPC .. H04S 1/002; H04S 2400/11; H04S 2400/15; H04S 2420/01; H04S 7/30; H04S 7/303
USPC ..... 381/17, 303, 309, 310; 700/94
See application file for complete search history.

(56) References Cited

U.S. PATENT DOCUMENTS

2006/0050909 A1* 3/2006 Kim ..... H04R 3/02 381/309
2007/0270988 A1* 11/2007 Goldstein ..... H04R 5/04 700/94
2009/0052703 A1* 2/2009 Hammershoi ..... H04S 7/302 381/310
2012/0328107 A1* 12/2012 Nystrom ..... H04S 7/303 381/17

(Continued)

FOREIGN PATENT DOCUMENTS

EP 2822301 A1 1/2015

OTHER PUBLICATIONS

Extended European Search Report for corresponding EP Application No. 20154866.6, 7 pages, dated Jun. 26, 2020.

(Continued)

*Primary Examiner* — Vivian C Chin
*Assistant Examiner* — Friedrich Fahnert
(74) *Attorney, Agent, or Firm* — Matthew B. Dernier, Esq.

(57) ABSTRACT

A system for generating a head-related transfer function, HRTF, dataset, the system comprising an HRTF dataset selection unit operable to select two or more HRTF datasets, a characteristic identification unit operable to identify characteristics of the selected HRTF datasets, an HRTF dataset modification unit operable to modify one or more elements of the one or more selected HRTF datasets in dependence upon deviations in identified characteristics of the HRTF datasets, and an HRTF dataset generation unit operable to generate a combined HRTF dataset comprising at least the modified HRTF elements.

9 Claims, 8 Drawing Sheets

(56) References Cited

U.S. PATENT DOCUMENTS

| | | | | |
|---|---|---|---|---|
| 2015/0010160 | A1 | 1/2015 | Udesen | |
| 2015/0124975 | A1* | 5/2015 | Pontoppidan | H04R 25/552 381/23.1 |
| 2016/0373877 | A1* | 12/2016 | Laitinen | H04S 7/304 |
| 2017/0238111 | A1 | 8/2017 | Kitazawa | |
| 2017/0251323 | A1* | 8/2017 | Jo | H04S 7/303 |
| 2017/0366913 | A1 | 12/2017 | Stein | |
| 2019/0014431 | A1* | 1/2019 | Lee | H04R 5/04 |
| 2019/0215637 | A1* | 7/2019 | Lee | G06K 9/6204 |
| 2019/0278802 | A1* | 9/2019 | Casimiro Ericsson | H04S 3/008 |
| 2020/0228915 | A1* | 7/2020 | Wang | H04S 7/306 |

OTHER PUBLICATIONS

Combined Search and Examination Report for corresponding GB Application No. 1902431.4, 2 pages, dated Aug. 18, 2019.

* cited by examiner

TRANSFER FUNCTION DATASET GENERATION SYSTEM AND METHOD

BACKGROUND OF THE INVENTION

Field of the Invention

This disclosure relates to a transfer function dataset generation system and method.

Description of the Prior Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

An important feature of human hearing is that of the ability to localise sounds in the environment. Despite having only two ears, humans are able to locate the source of a sound in three dimensions; the interaural time difference and interaural intensity variations for a sound (that is, the time difference between receiving the sound at each ear, and the difference in perceived volume at each ear) are used to assist with this, as well as an interpretation of the frequencies of received sounds.

As the interest in immersive video content increases, such as that displayed using virtual reality (VR) headsets, the desire for immersive audio also increases. Immersive audio should sound as if it is being emitted by the correct source in an environment, that is the audio should appear to be coming from the location of the virtual object that is intended as the source of the audio; if this is not the case, then the user may lose a sense of immersion during the viewing of VR content or the like. While surround sound speaker systems have been somewhat successful in providing audio that is immersive, the provision of a surround sound system is often impractical.

In order to perform correct localisation for recorded sounds, it is necessary to perform processing on the signal so as to generate the expected interaural time difference and the like for a listener. In previously proposed arrangements, so-called head-related transfer functions (HRTFs) have been used to generate a sound that is adapted for improved localisation. In general, an HRTF is a transfer function that is provided for each of a user's ears and for a particular location in the environment relative to the user's ears.

In general, a discrete set of HRTFs is provided (as an HRTF dataset) for a user and environment such that sounds can be reproduced correctly for a number of different positions in the environment relative to the user's head position. However, one shortcoming of this method is that there are a number of positions in the environment for which no HRTF is defined. Earlier methods, such as vector base amplitude panning (VBAP), have been used to mitigate these problems.

In addition to this, HRTFs are often not sufficient for their intended purpose; the required HRTFs differ from user to user, and so a generalised HRTF is unlikely to be suitable for a group of users. For example, a user with a larger head may expect a greater interaural time difference than a user with a smaller head when hearing a sound from the same relative position. In view of this, the HRTFs may also have different spatial dependencies for different users. The measuring of an HRTF can also be time consuming, expensive, and also suffer from distortions due to objects (such as the equipment in the room) in the HRTF measuring environment and/or a non-optimal positioning of the user within the HRTF measuring environment. There are therefore numerous problems associated with generating and utilising HRTFs.

SUMMARY OF THE INVENTION

It is in the context of the above problems that the present invention arises.

This disclosure is defined by claim 1.

Further respective aspects and features of the disclosure are defined in the appended claims.

It is to be understood that both the foregoing general description of the invention and the following detailed description are exemplary, but are not restrictive, of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
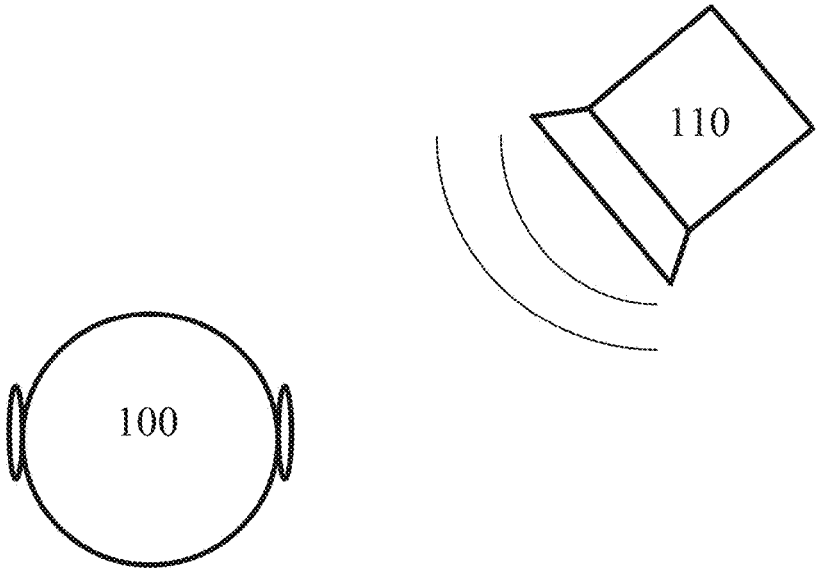
FIG. 1 schematically illustrates a user and sound source.

Referring now to the drawings, wherein like reference numerals designate identical or corresponding parts throughout the several views, embodiments of the present disclosure are discussed.

For many applications, such as listening to music, it is not considered particularly important to make use of an HRTF; the apparent location of the sound source is not important to the user's listening experience. However, for a number of applications the correct localisation of sounds may be more desirable. For instance, when watching a movie or viewing immersive content (such as during a VR experience) the apparent location of sounds may be extremely important for a user's enjoyment of the experience, in that a mismatch between the perceived location of the sound and the visual location of the object or person purporting to make the sound can be subjectively disturbing. In such embodiments, HRTFs are used to modify or control the apparent position of sound sources.

When it is considered useful to make use of HRTFs, it is usually the case that multiple HRTFs are provided as part of an HRTF dataset so as to enable a range of possible virtual sound source locations to be utilised. For example, an HRTF dataset may comprise a plurality of HRTFs that are generated using a recording apparatus with a specific set of parameters for a specific user. An example of this is the use of a specific set of equipment (sound generation and recording) in a single environment (such as an anechoic chamber) for a single user, at a uniform radial distance from the user (such as 1.5 metres away from the user). However, in many cases an HRTF dataset may not be sufficiently well-populated to serve as a useful reference. For example, an HRTF dataset may only include a small number of HRTFs and so either not represent a useful angular coverage (such as only covering the area in front of a user, but not behind) or the HRTFs may be spaced far enough apart that the accuracy of any interpolation may be compromised. Alternatively, or in addition, the HRTFs may not be provided for a sufficient range of radial distances from a user.

A first method for addressing this problem is that of performing an interpolation within an existing HRTF dataset in order to generate additional HRTFs that may be referred to during audio reproduction. However, there may be limitations to this—such as when the existing HRTF is particularly sparse, for example.

A second method for addressing this problem is that of combining HRTF datasets; this can address the problem of sparse datasets as associated with the first method above. By considering two or more HRTF data sets that are individually insufficient (or could be improved by performing a combination, despite being sufficient for use in audio reproduction), it may be possible to generate a single HRTF dataset that may be well-suited for use independently of further HRTF datasets. Such a combination is non-trivial, however, as differences in the recording environment and the like may lead to HRTFs that have frequency responses that differ for the same user and position pairings.

Of course, it is also considered that these two methods may be used together to generate a combined and well-populated HRTF dataset.

FIG. 1 schematically illustrates a user 100 and a sound source 110. The sound source 110 may be a real sound source (such as a physical loudspeaker or any other physical sound-emitting object) or it may be a virtual sound source, such as an in-game sound-emitting object, which the user is able to hear via a real sound source such as headphones or loudspeakers. As discussed above, a user 100 is able to locate the relative position of the sound source 110 in the environment using a combination of frequency cues, interaural time difference cues, and interaural intensity cues. For example, in FIG. 1 the user will receive sound from the sound source 110 at the right ear first, and it is likely that the sound received at the right ear will appear to be louder to the user.

Figure 2:
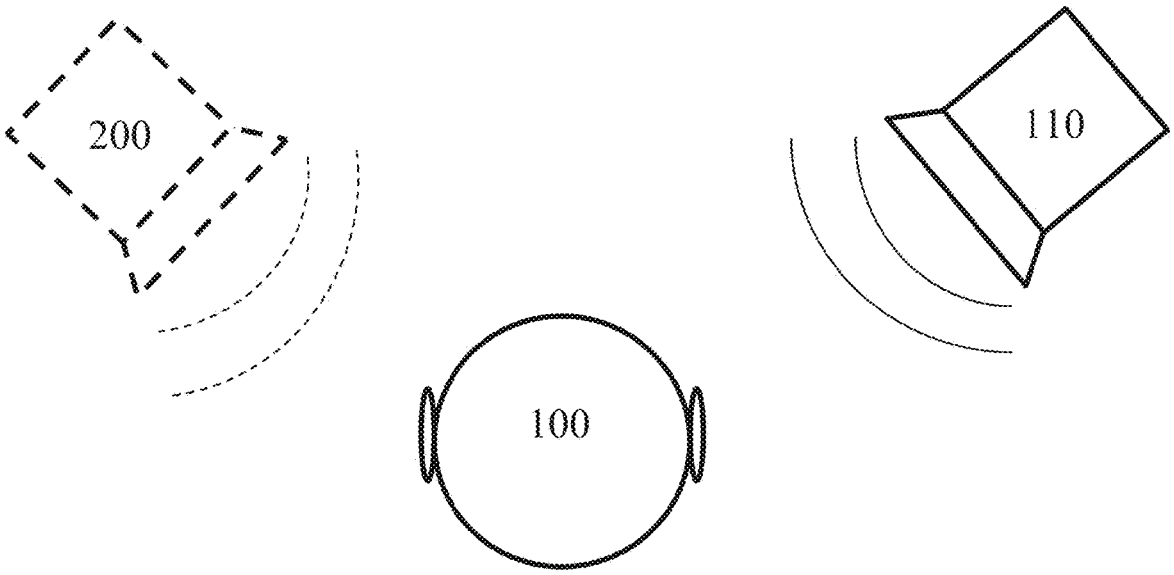
FIG. 2 schematically illustrates a virtual sound source.

FIG. 2 illustrates a virtual sound source 200 that is located at a different position to the sound source 110. It is apparent that for the user 100 to interpret the sound source 200 as being at the position illustrated, the received sound should arrive at the user's left ear first and have a higher intensity at the user's left ear than the user's right ear. However, using the sound source 110 means that the sound will instead reach the user's right ear first, and with a higher intensity than the sound that reaches the user's left ear, due to being located to the right of the user 100.

Figure 3:
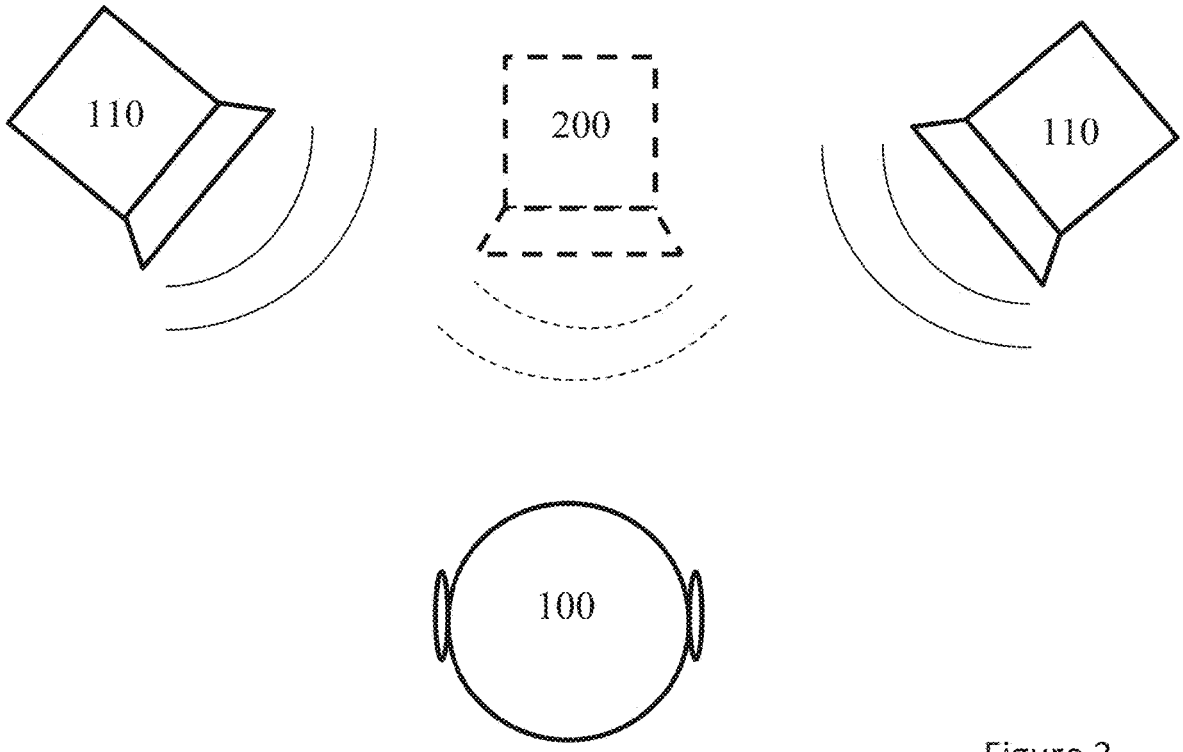
FIG. 3 schematically illustrates sound sources generating audio for a virtual sound source.

An array of two or more loudspeakers (or indeed, a pair of headphones) may be used to generate sound with an apparent source location that is different to that of the loudspeakers themselves. FIG. 3 schematically illustrates such an arrangement of sound sources 110. By applying an HRTF to the sounds generated by the sound sources 110, the user 100 may be provided with audio that appears to have originated from a virtual sound source 200. Without the use of an appropriate HRTF, it would be expected that the audio would be interpreted by the user 100 as originating from one/both of the sound sources 110 or another (incorrect for the virtual source) location.

It is therefore clear that the generation and selection of high-quality and correct HRTFs for a given arrangement of sound sources relative to a user is of importance for sound reproduction.

One method for measuring HRTFs is that of recording audio received by in-ear microphones that are worn by a user located in an anechoic (or at least substantially anechoic) chamber. Sounds are generated, with a variety of frequencies and sound source positions (relative to the user) within the chamber, by a movable loudspeaker. The in-ear microphones are provided to measure a frequency response to the received sounds, and processing may be applied to generate HRTFs for each sound source position in dependence upon the measured frequency response. Interaural time and level differences (that is, the difference between times at which each ear perceives a sound and the difference in the loudness of the sound perceived by each ear) may also be identified from analysis of the audio captured by the in-ear microphones.

The generated HRTF is unique to the user, as well as the positions of the sound source(s) relative to the user; however the generated HRTF may still serve as a reasonable approximation of the correct HRTF for another user and one or more other sounds source positions. For example, the interaural time difference may be affected by head/torso characteristics of a user, the interaural level difference by head, torso, and ear shape of a user, and the frequency response by a combination of head, pinna, and shoulder characteristics of a user. While such characteristics vary between users, the variation may be rather small in some cases and therefore it can be possible to select an HRTF that will serve as a reasonable approximation for the user in view of the small variation.

In order to generate sounds with the correct virtual sound source position, an HRTF is selected based upon the desired apparent position of the virtual sound source (in the example of FIG. 3, this is the position of the sound source 200). The audio associated with that sound source is filtered (in the frequency domain) with the HRTF response for that position, so as to modify the audio to be output such that a user interprets the sound source as having the correct apparent position in the real/virtual environment.

This filtering comprises the multiplication of complex numbers (one representing the HRTF, one representing the sound input at a particular frequency), which are usually represented in polar form with a magnitude and a phase. This multiplication results in a multiplying of the magnitude components of each complex number, and an addition of the phases. Of course, in some cases it is anticipated that a sound may wish to be generated so as to have an apparent position which has no associated HRTF for that user; this may be particularly true in the case in which a small HRTF dataset is being used. Frequency responses may be non-linear and difficult to predict, due to user-specific factors and the dependence on both elevation and distance. A simple interpolation is therefore not appropriate in this instance, as it would be expected that a simple averaging of HRTFs would lead to HRTFs that are incorrect.

A number of alternative interpolation techniques for generating sound at a location with no corresponding HRTF have been proposed, with VBAP (vector base amplitude panning) being a commonly used approach. VBAP provides a method which does not rely on the use of HRTFs; instead, the relative locations of existing (real) loudspeakers, virtual sound sources, and the user are used to generate a modified sound output signal for each loudspeaker. Using VBAP enables a sound to be generated as if it were positioned at any point on a three-dimensional surface defined by the location of the loudspeakers used to output sound to a user.

The standard three-dimensional VBAP method as discussed herein is disclosed in 'Virtual Sound Source Positioning Using Vector Base Amplitude Panning' (Pulkki, J. Audio Eng. Soc, Vol 45, No. 6, Jun. 1997). In this method, sounds are split into four separate channels—one for each of the three Cartesian coordinate axes and a fourth channel that contains a monophonic mix of the input sound. A gain factor is calculated for each of these, based upon the elevation and angle of the virtual sound source relative to the user.

A vector indicating the direction of the virtual sound source relative to the user is expressed as a linear combination of three real loudspeaker vectors (these being the three closest loudspeakers that bound the virtual sound source position), each of these vectors being multiplied by a corresponding gain factor. The gain factor corresponding to each of the loudspeaker vectors is calculated so as to solve the equation relating the loudspeaker positions and virtual sound source position, with both of these being known quantities.

By additionally making use of HRTFs with the VBAP method, it is possible to generate a three-dimensional sound field using only two loudspeakers; it may also be possible to generate a higher-quality sound output for a user. It may therefore be advantageous to combine these methods, despite the drawbacks (such as a significantly increased processing burden).

One method that has been suggested for combining these concepts is that of interpolating HRTFs in a similar fashion to that used in the VBAP method. However, this may result in an incorrect HRTF being generated due to the addition of the HRTFs. In some cases, this is because of phase differences between the HRTFs; the addition of the phase components can lead to unintended (and undesirable) attenuations to the output sound being introduced.

In embodiments of the present invention, a per-object minimum phase interpolation (POMP) method is employed to generate an effective interpolation of HRTFs. In summary, this method comprises an interpolation of the minimum phase components of HRTFs and a separate calculation of interaural time delay (based upon the original HRTFs, rather than processed HRTFs). This method is performed for each channel of the audio signal independently.

Figure 4:
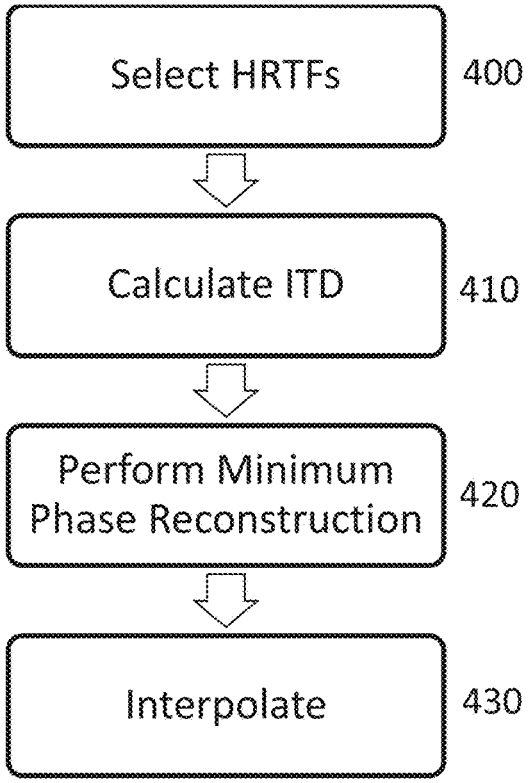
FIG. 4 schematically illustrates an HRTF generation method.

FIG. 4 schematically illustrates the use of the POMP method as outlined above. While the steps are provided in a particular order, in some embodiments one or more steps may be performed in a different order or omitted altogether. The below method comprises a method for generating a head-related transfer function, HRTF, for a given position with respect to a listener.

This given position may be determined in a number of ways; for example, an analysis of the positions of existing HRTFs in a dataset may be performed to identify suitable candidate locations for new HRTFs to be generated. For instance, HRTFs may be generated so as to reduce the maximum spacing between HRTFs or to provide a particular density of HRTFs in a particular area (such as a common sound source direction for an application).

At a step 400, HRTF selection is performed. This selection comprises identifying two or more HRTFs that define an area at a constant radial distance from the user in which the virtual sound source is present (or a line of constant radial distance on which the virtual sound source is present, in the case that only two HRTFs are selected). This can be performed using information about the position of the virtual sound source and the position of each of the available HRTFs for use. Where possible, HRTFs that are closer to the position of the virtual sound source may be preferably selected as this may increase the accuracy of the interpolation; that is, once the position of a virtual sound source (the position, relative to the user, for which an HRTF is desired) has been identified a calculation may be performed to determine the distance between this position and the locations associated with a number of the available HRTFs. These HRTFs may then be ranked in accordance with their proximity to the target position, and a selection made in view of the relative proximity and the requirement that the HRTFs bound an area/volume that includes the target position.

In some embodiments, only HRTFs that are present at the same radial distance from the user are considered when determining the closest HRTFs. Alternatively, HRTFs at any distance may be considered, and a weighting applied when ranking the HRTFs such that particular characteristics of the HRTF positions may be preferred. For instance, HRTFs may be given a higher ranking if they share the same (or similar) radial distance from the user as the target position, or a similar elevation.

While the selection described above refers to identifying two or more HRTFs that define an area at a fixed radial distance from the user, in some embodiments the HRTFs may not be defined for positions at an equal radial distance from the user. In such a case, the HRTFs may be selected so as to define a three-dimensional volume within which the virtual sound source (that is, the location for which an HRTF is desired) is present.

In some embodiments, HRTFs should be selected that correspond to locations that are the same radial distance from the listener as the virtual sound source to be modelled. While HRTFs that correspond to locations at different radial differences may be selected, the interpolation method would need to be adjusted so as to account for this difference (for example, but adjusting the interpolation coefficients to account for the different frequency responses resulting from the difference in radial distance from the listener, or to normalise the interaural time difference for distance of the HRTF from the listener).

At a step 420, the interaural time difference (ITD) is calculated. This calculation may be performed by converting the left and right signals to the frequency domain, and calculating and then unrolling the phases. The excess phase components are then obtained by computing the difference between the linear component of the phase (also known as the group delay) as extracted from the unrolled phases. The equation below illustrates this relationship, where the interaural time difference is represented by the letter TY, the frequency of the output sound is 'k', and 'H(k)' represents the HRTF for the frequency k. 'i' signifies an imaginary number, while 'φ' and 'μ' represent functions of the frequency k.

$$H[k] = |H[k]|e^{-i\varphi[k]} = \overbrace{|H[k]|e^{-i(\mu[k])}}^{Minimum\ Phase}\ \overbrace{e^{-i(2\pi kD/N)}}^{Excess\ Phase} \quad \text{Equation 1}$$

In some embodiments, the interaural time difference may be calculated in the time domain instead of using the frequency-domain calculation above. For example, an approximation of the interaural time delay could be generated by comparing the timing of the signal peaks present in left and right channels of the audio. Alternatively, a cross-correlation function can be applied to the left and right head-related impulse responses to identify the indices where maxima in the responses occur, and to calculate an interaural time difference by converting frequency differences to time differences using the sampling rate of the signal.

At a step 420, a suitable minimum phase reconstruction is performed. This step is used to approximate a minimum phase filter based upon the HRTF magnitude, rather than by calculating the minimum phase for the HRTF directly. An approximation may be particularly appropriate here as the minimum phase component has little or no contribution to the ability of a user to localise the output audio, although in some embodiments a direct calculation of the minimum phase component may of course be performed. At a step 430, an interpolation of the reconstructed minimum phase components is performed. In some embodiments this is performed using a VBAP method as described above, however any suitable process may be used. The output of this process is an HRTF that is suitable for the desired virtual sound source position.

Figure 5:
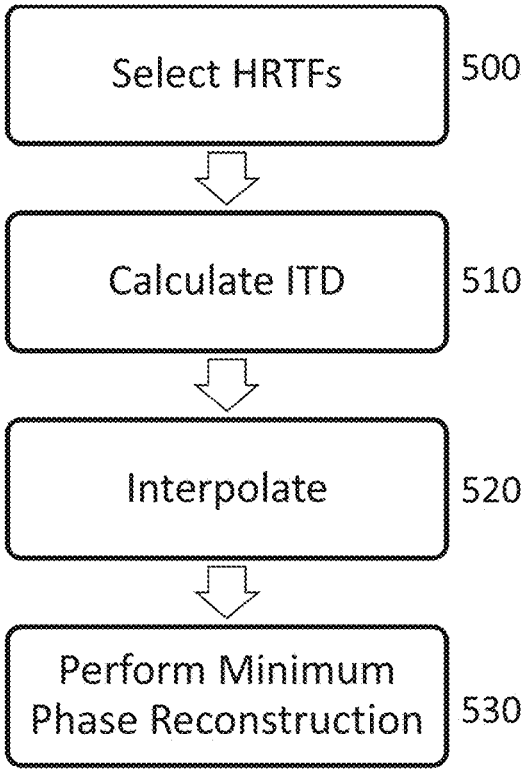
FIG. 5 schematically illustrates a further HRTF generation method.

FIG. 5 schematically illustrates an alternative POMP method that may be utilised instead of the method of FIG. 4. Rather than applying the interpolation processing to the minimum phase components only, the interpolation process is applied to the magnitudes of the HRTFs so as to reduce the effects of phase differences between the HRTFS. While the below steps are provided in a particular order, in some embodiments one or more steps may be performed in a different order or omitted altogether.

The processing of steps 500 and 510 is performed in the same manner as that of the steps 400 and 410 described above with reference to FIG. 4, and as such these steps are not discussed in detail below.

At a step 500, the selection of appropriate HRTFs for interpolation is performed.

At a step 510, the interaural time difference (ITD) is calculated for the selected HRTFs.

At a step 520, an interpolation of the magnitudes of the HRTFs is performed; any phase components are omitted from this calculation. In some embodiments this is performed using a VBAP method as described above, however any suitable process may be used. The output of this process is an HRTF that is suitable for the desired virtual sound source position.

The interpolation of only the magnitudes of the selected HRTFs may be particularly advantageous for moving virtual sound sources, as this is often where errors in the generated HRTF resulting from the interpolation of phase components become apparent.

At a step 530, a suitable minimum phase reconstruction is performed upon the interpolated HRTF that is generated in step 520. By performing this reconstruction post-interpolation, phasing artefacts may be significantly reduced or eliminated.

Figure 6:
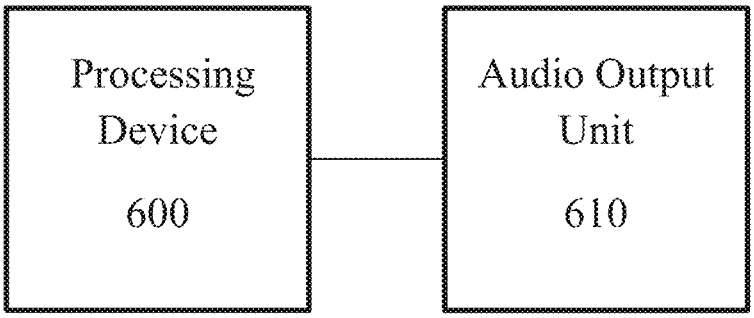
FIG. 6 schematically illustrates a sound generation and output system.

FIG. 6 schematically illustrates a system for generating sound outputs for a desired position using a generated HRTF for that position based upon a number of existing HRTFs. This system comprises a processing device 600 and an audio output unit 610.

The processing device 600 is operable to generate HRTFs for given positions by performing an interpolation process upon existing HRTF information, such as by performing a method described above with reference to FIG. 4 or 5. The functionality of the processing device 600 is described further below.

The audio output unit 610 is operable to reproduce an output sound signal generated by the processing device 600. The audio output unit 610 may comprise one or more loudspeakers, and one or more audio output units 610 may be provided for playback of the output sound signal.

Figure 7:
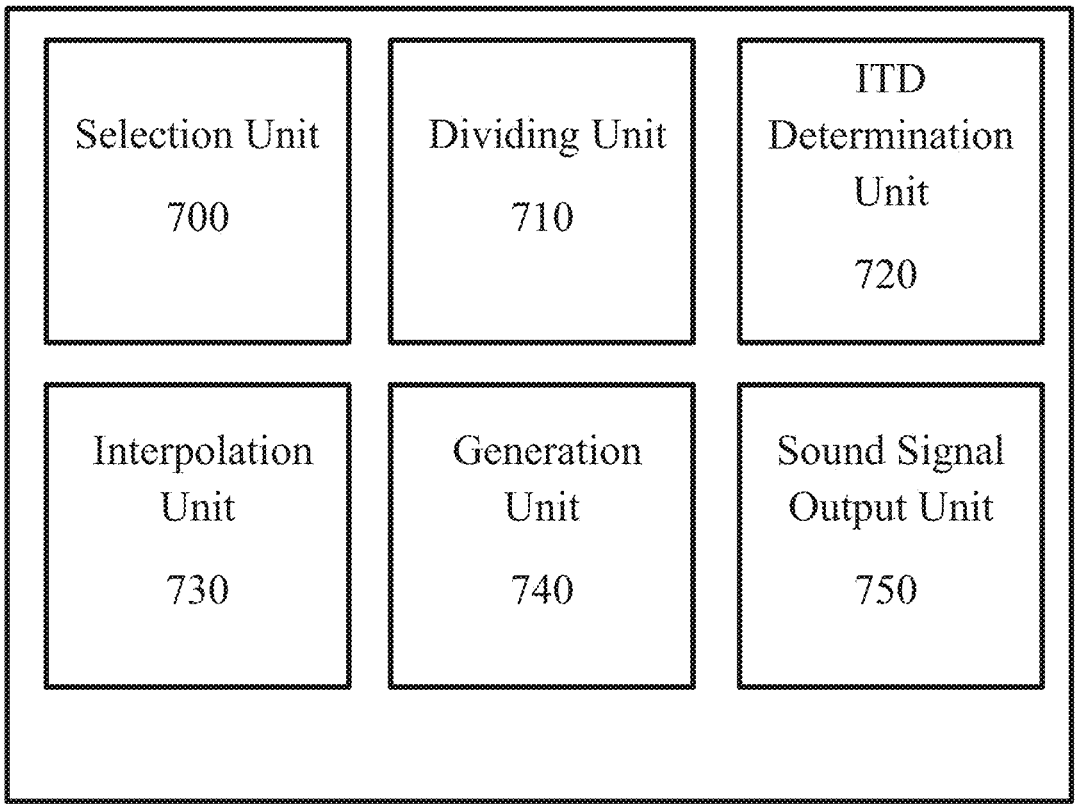
FIG. 7 schematically illustrates a processing unit forming a part of the sound generation and output system.

FIG. 7 schematically illustrates the processing device 600. The processing device 600 comprises a selection unit 700, a dividing unit 710, an interaural time difference determination unit 720, an interpolation unit 730, a generation unit 740, and a sound signal output unit 750. The selection unit 700 is operable to select two or more HRTFs in dependence upon the given position for which an HRTF is desired. For example, this may comprise the selection of HRTFs with a position that is closest to the given position. In some embodiments, the positions of the selected HRTFs define a line or surface encompassing the given position, as described above.

The dividing unit 710 is operable to divide each of a plurality of existing HRTFs, each corresponding to a respective plurality of positions, into first and second components. The first and second components may be determined as appropriate; for example, in the method of FIG. 4 these are the excess and minimum phase components respectively. In the example of FIG. 5, these components are the excess phase component and the HRTF magnitude respectively. In some embodiments, the dividing unit 710 is operable to generate the minimum phase component using a minimum phase reconstruction method. In one or more other embodiments, the dividing unit 710 is operable to generate a minimum phase component by performing a minimum phase reconstruction method on the interpolated HRTF.

The interaural time difference determination unit 720 is operable to determine an interaural time difference expected by a user for a sound source located at the given position in dependence upon the respective first components of the HRTFs.

The interpolation unit 730 is operable to generate an interpolated second component by interpolating generated second components using a weighting dependent upon the respective positions for the corresponding HRFTs and the given position.

The generation unit 740 is operable to generate an HRTF for the given position in dependence upon the interaural time difference and the interpolated second component. In some embodiments, the generation unit 740 is operable to apply a time delay (as calculated by the interaural time difference determination unit 720) to the generated sound signal in dependence upon the interaural time difference. The generation unit 740 may also be operable to generate a sound signal by multiplying the generated HRTF and a sound to be output.

The sound signal output unit 750 is operable to output a sound signal in accordance with a generated sound signal that is generated in dependence upon the generated HRTF. One or more audio output units 610 may be operable to reproduce the output sound signal.

By utilising the above system and methods, or suitable alternatives, interpolation of existing HRTFs in a dataset may be performed in order to generate a more comprehensive HRTF dataset. We now turn to a discussion of the combination of existing HRTF datasets, which as noted above may be used in conjunction with, or instead of, the above interpolation methods.

Figure 8:
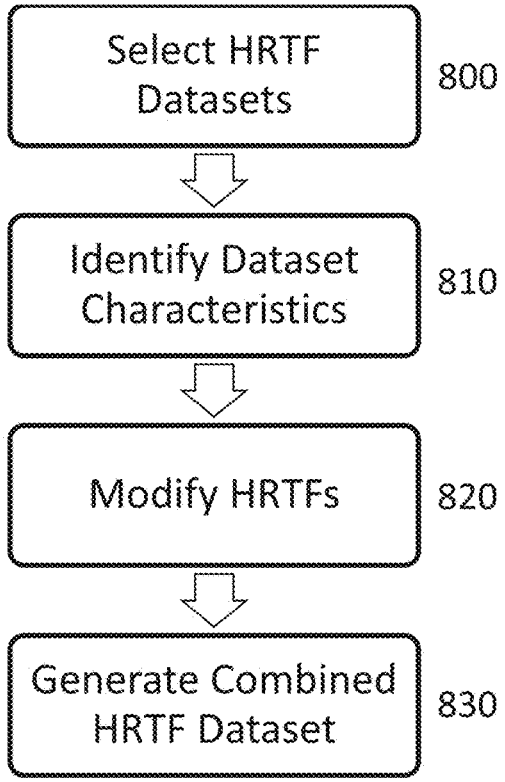
FIG. 8 schematically illustrates an HRTF dataset combination method.

When combining HRTF datasets, it is considered important that processing be performed to standardise the frequency responses between the different HRTFs that are present. If such processing is not performed, then issues with user sound localisation may arise which can lead a user to interpret sounds as coming from different locations to those which are intended. FIG. 8 schematically illustrates a method for combining two or more HRTF datasets.

A step 800 comprises selecting two or more HRTF datasets for combination.

HRTF datasets may be selected in any suitable manner. For example, these may be user-selected HRTF datasets, such as those selected from an online database or those generated by the user themselves. Alternatively, or in addition, HRTF datasets may be selected automatically (or recommended in dependence upon) one or more characteristics of the user or their environment. For example, HRTF datasets captured in an environment similar to that in which the user is listening to the audio playback or HRTF datasets captured for users of a similar physical appearance to the user may be preferentially selected/recommended as these may serve as a closer approximation of the desired HRTF dataset.

A step 810 comprises identifying characteristics of the selected HRTF datasets. This may include identifying information about individual HRTFs (such as position relative to a user) and/or information about the set as a whole (such as the number/density of HRTFs). While this may be performed by analysing metadata associated with the HRTF dataset, in some embodiments this step may instead (or additionally) include the performing of an analysis of one or more of the HRTFs in the dataset to identify the characteristics independently.

For example, an analysis may include identifying each (or at least a subset) of the HRTFs in the dataset and subsequently generating a map (or a list) of the positions of each of the HRTFs relative to a listener. Further analysis may also be performed, for example to identify the density of HRTFs in one or more locations (for example, in front of the listener). This can assist in identifying shortcomings (or areas for improvement) of the HRTF datasets, which may modify how the combining of the HRTF datasets is performed.

A step 820 comprises modifying one or more elements of the one or more selected HRTF datasets in dependence upon deviations in identified characteristics of the HRTF datasets.

For example, this may include the modification of one or more HRTFs in the dataset so as to account for the recording conditions or equipment with which the HRTFs in the dataset were captured. These modifications may comprise an alteration of the interaural time difference associated with an HRTF, an interaural level difference, frequency response amplitude, the location of peaks (or the like) in the frequency response, or indeed any other suitable characteristic of the HRTF.

In some embodiments, artefacts resulting from errors or interference in the HRTF capturing process may also be addressed by the modification of step 820. For example, HRTFs that are not captured in an (at least substantially) anechoic environment will be subject to artefacts resulting from the echoes that are generated. Further to this, the presence of equipment (such as that for generating the sounds used for the HRTF generating process) and even the user in the environment will affect how the sound waves propagate in the environment and therefore impact the HRTF that is recorded.

A step 830 comprises generating a combined HRTF dataset, which may be referred to as an HRTF database, comprising at least the modified HRTF elements. This step comprises the generation of a single dataset that comprises at least a subset of elements derived from each of the selected HRTF datasets; that is, elements (such as HRTFs) from each of the selected HRTF datasets are included in the combined HRTF dataset in either their original or modified form.

As a part of the modification or combination steps above, further HRTFs may be generated to be included in the combined HRTF dataset using an interpolation method (such as that discussed with reference to FIG. 4). This may be performed using HRTFs of individual datasets (that is, HRTFs that have not been modified for combination), or using HRTFs belonging to the combined HRTF dataset that is generated.

FIGS. 9-12 schematically illustrate examples of variations in HRTFs that may be considered when performing a modification to an HRTF dataset prior to a combination.

Figure 9:
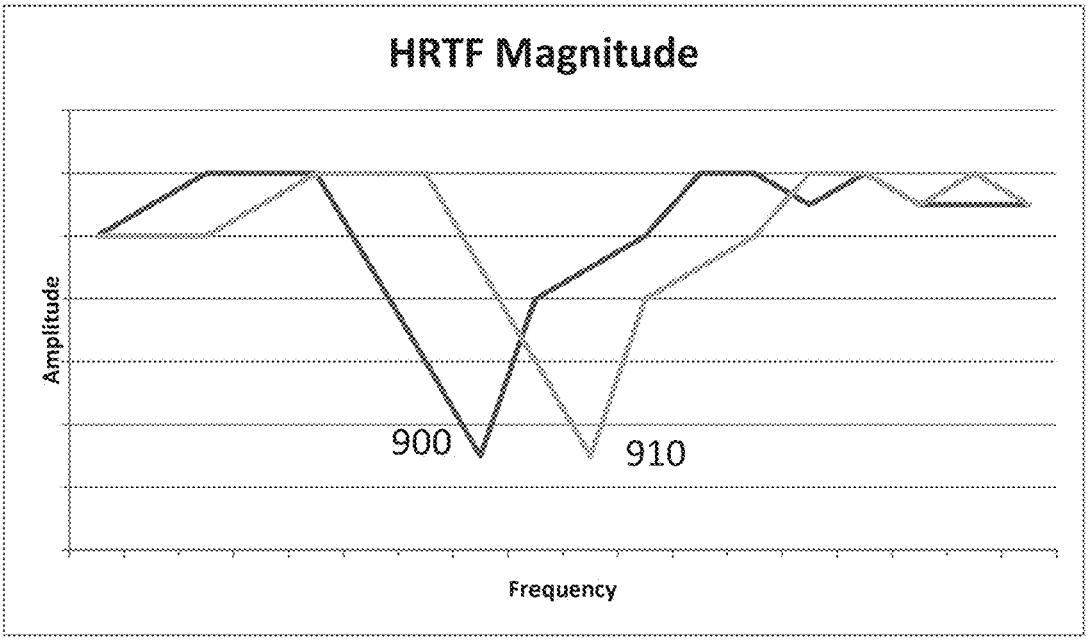
FIGS. 9-12 schematically illustrate examples of variations of HRTF characteristics.

FIG. 9 schematically illustrates a simplified pair of frequency responses (900, 910) in which the amplitude of the HRTF magnitude increases along the vertical axis and the frequency increases along the horizontal axis. In this example, the frequency response varies between the two plots shown in that specific amplitude features in the plot appear at a higher frequency for the response 910 than the response 900.

Of course, this translation is a simplified example of differences between responses; it would be expected that the differences between the two frequency responses would extend beyond a simple translation. For example, the amplitude for each of these features may vary, and different parts of the frequency response may be translated by different amounts. For instance, the peaks/troughs may have different relative positions to one another in the respective responses.

Such a translation in the location of the peaks and troughs in the frequency response of the HRTFs may be caused by the HRTFs being captured at a different elevation with respect to the user, for example.

Figure 10:
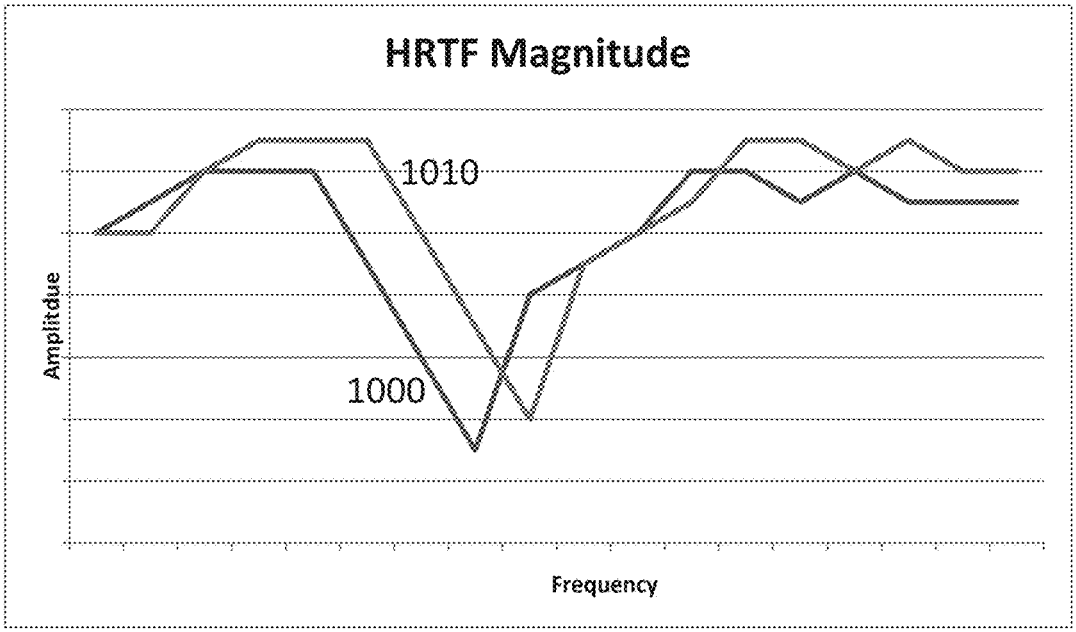

FIG. 10 schematically illustrates a second simplified pair of frequency responses (1000, 1010), in which in addition to a translation the minimum/maximum amplitudes of the HRTF magnitude are increased. This may be caused by the frequency response 1010 being associated with an HRTF for a position closer to the user than that of the frequency response 1000, for example.

Each of FIGS. 9 and 10 illustrate possible variations in the HRTF magnitudes that may be addressed by the modification described above when combining HRTF datasets. The specific values of the shifts may vary in dependence upon the HRTF capturing environment, the user, and/or the HRTF capturing equipment, rather than just the position. Information relating to each of these factors may be considered when identifying an appropriate modification to be made.

Figure 11:
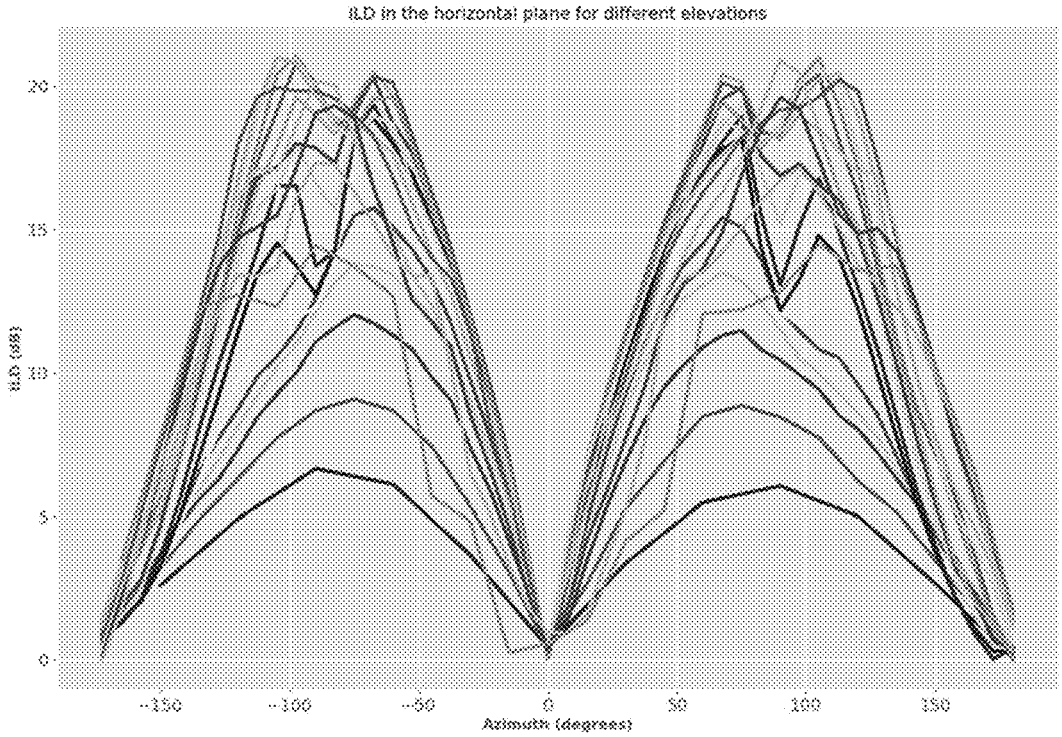

FIG. 11 schematically illustrates the variation in the interaural level difference with elevation for a plurality of HRTFs, for a constant radial distance from the user and a fixed altitude (horizontal, in this case) relative to the user's head. Each of the plotted lines represents measurements taken at different elevations of a sound source.

As can be seen from this Figure, the interaural level difference is zero (or at least close to zero) when the sound source is directly in front of a user; similarly, the interaural level difference approaches zero as the azimuthal angle approaches 180 degrees (that is, when the sound source is directly behind the user). The shape and magnitude of the interaural level difference peaks in this Figure vary depending on the elevation of the sound source relative to a user; in general, the magnitude increases as the elevation increases and the higher elevations tend to have more than one peak.

Modelling these patterns for a user and/or environment can assist in generating a standardised HRTF dataset. For instance, an HRTF may be modified in order to account for the interaural level difference that arises from environmental factors (such as the room in which an HRTF were generated) or for the equipment used to record the HRTF. In addition to this, or as an alternative, the HRTF could be modified to account for differences in a user's physical characteristics.

Figure 12:
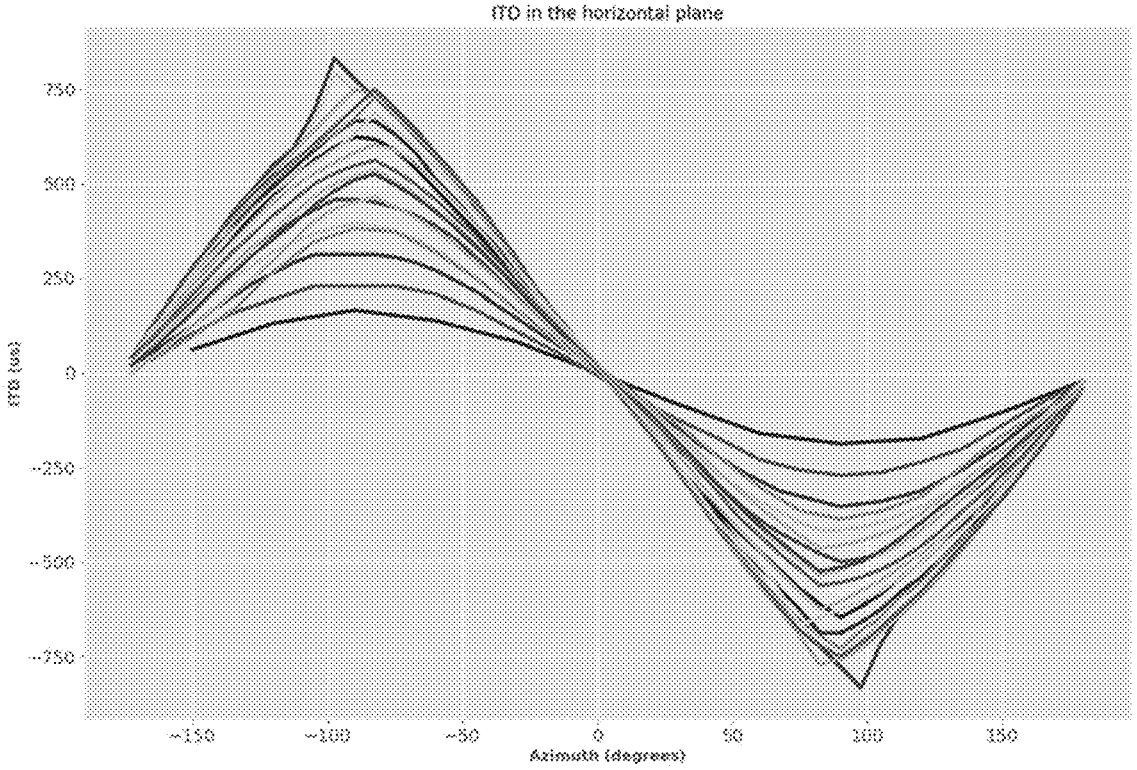

FIG. 12 schematically illustrates the variation in the interaural time delay with elevation for a plurality of HRTFs, for a constant radial distance from the user and a fixed altitude (horizontal, in this case) relative to the user's head. Each of the plotted lines represents measurements taken at different elevations of a sound source.

As can be seen from this Figure, the interaural time difference is zero (or at least close to zero) when the sound source is directly in front of a user; similarly, the interaural time difference approaches zero as the azimuthal angle approaches 180 degrees (that is, when the sound source is directly behind the user). The interaural time difference is calculated as the time of perception by the left ear subtracted from the time of perception by the right ear (where a negative azimuthal angle indicates a movement of the HRTF to the left of a user); a negative value (as shown in the right half of the Figure) therefore indicates that the right ear perceives the sound at an earlier time than the left ear.

Modelling these patterns for a user and/or environment can assist in generating a standardised HRTF dataset. For instance, an HRTF may be modified in order to account for the interaural time difference that arises from environmental factors (such as the room in which an HRTF were generated) or for the equipment used to record the HRTF. In addition to this, or as an alternative, the HRTF could be modified to account for differences in a user's physical characteristics.

Figure 13:
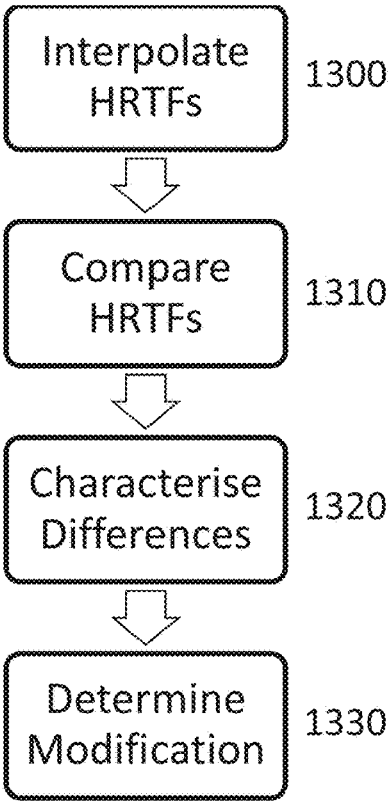
FIG. 13 schematically illustrates an HRTF standardisation method.

FIG. 13 schematically illustrates a method of determining a modification that should be applied to one or more HRTFs, for example as a part of step 820 of FIG. 8.

A step 1300 comprises interpolating the HRTFs of each of the HRTF datasets in order to generate one or more HRTFs for each dataset for each of one or more positions relative to a user. Such a step may be advantageous in identifying variations in the HRTFs due to the environment and/or other factors influencing the HRTF generation process by eliminating differences in the HRTF arising solely from differences in position relative to the user. Of course, in some embodiments such a step may be omitted; for example, when HRTFs already exist for the same position, when a simple transform may be applied in order to account for the positional differences (for example, if the positional differences are sufficiently small), or when a comparison between HRTFs is used that does not rely upon the HRTFs that are being compared being associated with the same position.

A step 1310 comprises comparing one or more HRTFs from each of the selected HRTF datasets and identifying any differences between them. In some embodiments, the selected HRTFs are defined for the same position (for example, using the HRTFs generated in step 1300), while in others processing may be performed to account for these differences during the comparison.

In some embodiments, this comparison comprises a direct comparison between the amplitude of frequency responses (for example, comparing one or more specific values or characteristics of the responses, such as amplitude) of each of the HRTFs being compared. Alternatively, or in addition, the interaural time or level differences may be compared between these HRTFs.

In some cases, it is necessary to perform a more detailed analysis (rather than a comparison between a small number of HRTFs from each dataset) in order to account for differences in HRTF characteristics within a single HRTF dataset. It may be the case that the analysis includes a comparison of characteristics of the HRTF datasets as a whole, and/or a comparison of a larger number of HRTFs from each dataset.

This analysis may include a comparison between HRTFs of the same dataset before a comparison is made between different HRTF datasets. For example, the average interaural level difference and/or interaural time difference may be calculated for each HRTF dataset—these may be compared to assist with combining the datasets in a consistent manner.

A step 1320 comprises characterising the differences between the two or more HRTFs that are compared in step 1310. A characterisation of the differences may comprise determining the cause of differences between the HRTFs (for example, identifying that two HRTFs were captured with different equipment or in different environments), or more simply identifying what the differences are. For example, an analysis may be performed that identifies the offset between different peaks (or other features of the response), or an analysis that identifies a function that describes (or at least approximates) a transform between the respective HRTF responses.

A step 1330 comprises determining the modification that is to be applied to one or more HRTFs in one or more of the selected HRTF datasets based upon the characterisation of the differences between the compared HRTFs in step 1320. For example, HRTFs of at least one of the HRTF datasets to be combined may be modified to generate a set of HRTFs that may be combined to form a single, accurate HRTF dataset for a user.

For example, this modification may comprise applying a transform to an HRTF so as to provide a frequency response that is in keeping with other HRTFs in the combined dataset (such as a transform that would reduce the environmental effects on the HRTF, or reproduce similar environmental effects in the HRTF as those contributing to other HRTFs in the combined dataset).

More specifically, a transform may be applied to one or more HRTFs from one or more of the selected HRTF datasets that modifies the HRTFs to approximate an expected HRTF for the user's current environment or an expected HRTF for the same position in another of the HRTF datasets.

Alternatively, or in addition, modifications may be applied that standardise the HRTF datasets as a whole. For example, modifications may be applied to one or more individual HRTFs to ensure that the correct interaural time delay and/or interaural level difference is observed for each HRTF position in the combined HRTF dataset. The modification to be applied may be determined in dependence upon position information for the HRTF as well as a determination of the correct interaural time delay and/or interaural level difference for an HRTF dataset.

As a further alternative or additional modification, processing may be applied to one or more HRTFs belonging to the HRTF datasets so as to account for the different equipment used in recording the HRTF datasets. For example, different HRTFs may be generated under identical conditions if different recording equipment (such as a loudspeaker for generating audio or an in-ear microphone for capturing the audio) is used. It may therefore be advantageous to negate these effects by reducing the contribution of the equipment to inaccuracies in the HRTF.

Of course, any suitable method of determining modifications to be applied may be used; the present invention is not limited to the method described with reference to FIG. 13. For example, information about the environment in which the HRTF dataset were captured may be obtained (for example, from metadata associated with the HRTF or measurements/information provided by a user) and a modification applied in dependence upon this information.

In some embodiments, it may be appropriate to implement machine learning techniques when performing a HRTF dataset combination method. Such methods may be particularly suitable for use in these embodiments in view of the complexity of the HRTFs; machine learning techniques may be well-suited for identifying correlations and trends between different HRTF datasets and/or between different HRTFs belonging to a single HRTF dataset.

For example, Generative Adversarial Networks (GANs) may be used to train a machine learning system. The target in such a network may be the characterisation of an HRTF (such as a generated or modified HRTF) as belonging to (that is, being suitable for) a specific HRTF dataset—the generated/modified HRTFs act as the generated input for the GAN. HRTFs that have been added to a dataset (or modified within that dataset) may be identified within a training data set (for example, as labelled by an operator), and a discriminator may be operable to distinguish between suitable and unsuitable HRTFs for a dataset based upon recognised patterns in the HRTFs belonging to a dataset. Examples of useful training data include manually generated HRTFs along with existing (measured) HRTF datasets. In this manner, it is possible to train a GAN to identify the characteristics that make an HRTF suitable for a particular HRTF dataset.

Figure 14:
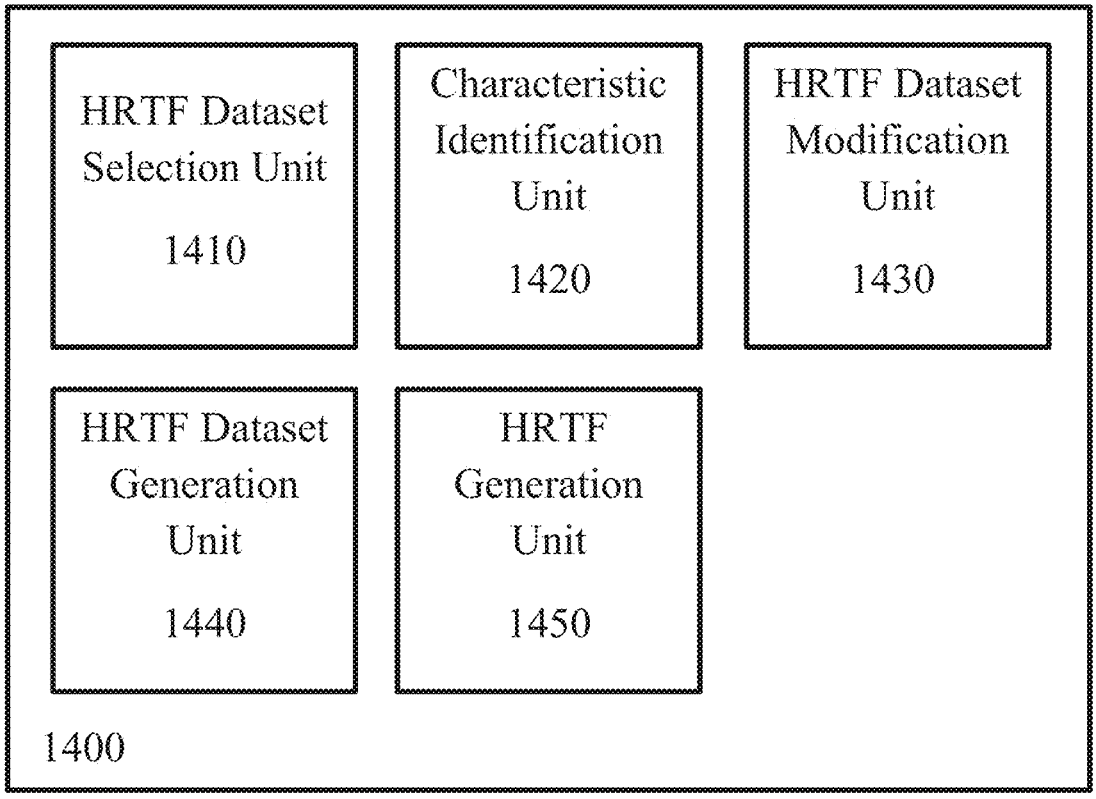
FIG. 14 schematically illustrates an HRTF dataset combination system.

FIG. 14 schematically illustrates a system 1400 for combining two or more HRTF datasets. The system comprises an HRTF dataset selection unit 1410, a characteristic identification unit 1420, an HRTF dataset modification unit 1430, an HRTF dataset generation unit 1440, and an HRTF generation unit 1450.

The HRTF dataset selection unit 1410 is operable to select two or more HRTF datasets.

The characteristic identification unit 1420 is operable to identify characteristics of the selected HRTF datasets. For example, this may include the analysis discussed with reference to steps 810 and 1320 as discussed above.

The HRTF dataset modification unit 1430 is operable to modify one or more elements of the one or more selected HRTF datasets in dependence upon deviations in identified characteristics of the HRTF datasets. These elements may be the any aspect of one or more HRTFs in a dataset, such as the frequency response or interaural time delay, for example.

In some embodiments the HRTF dataset modification unit 1430 is operable to modify the interaural level difference and/or interaural time delay for one or more HRTFs in one or more selected HRTF datasets. Alternatively, or in addition, the HRTF dataset modification unit 1430 may be operable to modify the frequency response of one or more HRTFs in one or more selected HRTF datasets.

These modifications may be performed in dependence upon any characteristics or other features of the HRTFs or HRTF datasets. For example, the HRTF dataset modification unit 1430 may be operable to modify one or more HRTFs in dependence upon the HRTF recording equipment. Alternatively, or in addition, the HRTF dataset modification unit 1430 is operable to modify one or more HRTFs in dependence upon the environment in which the HRTF was recorded.

The HRTF dataset modification unit may be operable to modify one or more HRTFs to generate a set of HRTFs that correspond to the same HRTF recording environment and user profile. In some examples, this may be the reproduction environment of the user. Alternatively, this may be the recording environment/use profile of one of the selected HRTF datasets or a predetermined reference recording environment/user.

The HRTF dataset generation unit 1440 is operable to generate a combined HRTF dataset comprising at least the modified HRTF elements.

The HRTF generation unit 1450 is operable to generate one or more HRTFs for the combined HRTF dataset. In some embodiments, the HRTF generation unit is operable to generate one or more HRTFs by interpolating HRTFs present in a selected HRTF dataset. Alternatively, or in addition, the HRTF generation unit is operable to generate one or more HRTFs by interpolating HRTFs present in the combined HRTF dataset.

The techniques described above may be implemented in hardware, software or combinations of the two. In the case that a software-controlled data processing apparatus is employed to implement one or more features of the embodiments, it will be appreciated that such software, and a storage or transmission medium such as a non-transitory machine-readable storage medium by which such software is provided, are also considered as embodiments of the disclosure.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A system for generating a head-related transfer function, HRTF, dataset, the system comprising:

an HRTF dataset selection unit operable to select two or more HRTF datasets;

a characteristic identification unit operable to identify characteristics of the selected HRTF datasets;

an HRTF dataset modification unit operable to modify one or more elements of the one or more selected HRTF datasets in dependence upon deviations in identified characteristics of the HRTF datasets; and an HRTF dataset generation unit operable to generate a combined HRTF dataset comprising at least the modified HRTF elements, wherein at least one of:

the HRTF dataset modification unit is operable to modify one or more HRTFs in dependence upon the HRTF recording equipment, and the HRTF dataset modification unit is operable to modify one or more HRTFs in dependence upon the environment in which the HRTF was recorded.

2. The system of claim 1, comprising an HRTF generation unit operable to generate one or more HRTFs for the combined HRTF dataset.

3. The system of claim 2, wherein the HRTF generation unit is operable to generate one or more HRTFs by interpolating HRTFs present in a selected HRTF dataset.

4. The system of claim 2, wherein the HRTF generation unit is operable to generate one or more HRTFs by interpolating HRTFs present in the combined HRTF dataset.

5. The system of claim 1, wherein the HRTF dataset modification unit is operable to modify the interaural level difference and/or interaural time delay for one or more HRTFs in one or more selected HRTF datasets.

6. The system of claim 1, wherein the HRTF dataset modification unit is operable to modify the frequency response of one or more HRTFs in one or more selected HRTF datasets.

7. The system of claim 1, wherein the HRTF dataset modification unit is operable to modify one or more HRTFs to generate a set of HRTFs that correspond to the same HRTF recording environment and user profile.

8. A method for generating a head-related transfer function, HRTF, dataset, the method comprising:

selecting two or more HRTF datasets;

identifying characteristics of the selected HRTF datasets;

modifying one or more elements of the one or more selected HRTF datasets in dependence upon deviations in identified characteristics of the HRTF datasets; and generating a combined HRTF dataset by a processor, where the combined HRTF dataset includes at least the modified HRTF elements, wherein at least one of:

the modifying step includes modifying one or more HRTFs in dependence upon the HRTF recording equipment, and the modifying step includes modifying one or more HRTFs in dependence upon the environment in which the HRTF was recorded.

9. A non-transitory machine-readable storage medium which stores computer software which, when executed by a computer, causes the computer to perform a method for generating a head-related transfer function, HRTF, dataset, the method comprising:

selecting two or more HRTF datasets;

identifying characteristics of the selected HRTF datasets;

modifying one or more elements of the one or more selected HRTF datasets in dependence upon deviations in identified characteristics of the HRTF datasets; and generating a combined HRTF dataset comprising at least the modified HRTF elements, wherein at least one of:

the modifying step includes modifying one or more HRTFs in dependence upon the HRTF recording equipment, and the modifying step includes modifying one or more HRTFs in dependence upon the environment in which the HRTF was recorded.

* * * * *